US012252882B2

(12) United States Patent
Long et al.

(10) Patent No.: US 12,252,882 B2
(45) Date of Patent: Mar. 18, 2025

(54) CURTAIN WALL INSULATION SYSTEM

(71) Applicant: Owens Corning Intellectual Capital, LLC, Toledo, OH (US)

(72) Inventors: Jack Long, Fort Wayne, IN (US); Angela Ogino, Urbana, IN (US); Michael Szajna, Huntington, IN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 18/914,397

(22) Filed: Oct. 14, 2024

(65) Prior Publication Data

US 2025/0034864 A1 Jan. 30, 2025

Related U.S. Application Data

(63) Continuation of application No. 18/254,742, filed as application No. PCT/US2021/029530 on Apr. 28, 2021.

(60) Provisional application No. 63/132,862, filed on Dec. 31, 2020.

(51) Int. Cl.
*E04B 2/96* (2006.01)

(52) U.S. Cl.
CPC ..... *E04B 2/96* (2013.01)

(58) Field of Classification Search
CPC ..... E04B 2/96; E04B 1/7629; E04B 1/948; E04B 2001/389
See application file for complete search history.

(56) References Cited

U.S. PATENT DOCUMENTS

| | | | |
|---|---|---|---|
| 529,331 | A | 11/1894 | Lane |
| 4,449,341 | A | 5/1984 | Taglianetti et al. |
| 4,471,592 | A | 9/1984 | Mackinnon, Jr. et al. |
| 4,512,130 | A | 4/1985 | Pepin |
| 4,576,532 | A | 3/1986 | Hanson et al. |
| 4,653,241 | A | 3/1987 | Bindi |
| 4,918,879 | A | 4/1990 | Bodurow et al. |
| 4,918,893 | A | 4/1990 | Vandenbroucke et al. |
| 5,058,352 | A | 10/1991 | Loiselle et al. |
| 5,060,441 | A | 10/1991 | Pichette |
| 5,299,403 | A | 4/1994 | Fentz |
| 5,502,937 | A | 4/1996 | Wilson |

(Continued)

FOREIGN PATENT DOCUMENTS

| | | | |
|---|---|---|---|
| WO | 2005090697 | A1 | 9/2005 |
| WO | 2021222335 | A1 | 11/2021 |
| WO | 2021222337 | A1 | 11/2021 |

OTHER PUBLICATIONS

International Search Report and Written Opinion from PCT/US21/29530 dated Aug. 3, 2021.

(Continued)

*Primary Examiner* — Patrick J Maestri
(74) *Attorney, Agent, or Firm* — Calfee, Halter & Griswold LLP

(57) ABSTRACT

A system for insulating a curtain wall structure is disclosed. The system includes a plurality of insulation hangers, a curtain wall insulation, and a safing insulation. The insulation hangers include a reinforcing member that engages a horizontal transom of the curtain wall structure. The system is attached only to horizontal transoms of the curtain wall structure via the insulation hangers to provide ease of installation and/or enhanced reliability.

23 Claims, 7 Drawing Sheets

(56) References Cited

U.S. PATENT DOCUMENTS

| | | | | |
|---|---|---|---|---|
| 5,519,977 | A | 5/1996 | Callahan et al. | |
| 5,664,392 | A | 9/1997 | Mucha | |
| 5,715,637 | A | 2/1998 | Hesterman et al. | |
| 5,765,332 | A | 6/1998 | Landin et al. | |
| 5,845,440 | A | 12/1998 | Matsuyama et al. | |
| 5,875,604 | A | 3/1999 | Rudd | |
| 6,430,885 | B1 | 8/2002 | Ito | |
| 6,457,292 | B1 | 10/2002 | Vrana | |
| 6,612,090 | B1 | 9/2003 | Corden | |
| 6,925,768 | B2 | 8/2005 | Hohmann et al. | |
| 7,278,244 | B1 | 10/2007 | Rubio | |
| 7,424,793 | B1 * | 9/2008 | Shriver | E04B 2/88 52/235 |
| 7,739,844 | B2 | 6/2010 | Gharibeh et al. | |
| 7,765,753 | B1 | 8/2010 | Shriver | |
| 7,886,491 | B1 | 2/2011 | Shriver | |
| 8,454,485 | B1 * | 6/2013 | Hodes | A63B 21/072 482/141 |
| 8,671,645 | B1 | 3/2014 | Shriver | |
| 8,683,763 | B2 | 4/2014 | Shriver | |
| 9,016,014 | B2 | 4/2015 | Shriver | |
| 9,790,683 | B1 | 10/2017 | Harkins | |
| 10,202,759 | B2 | 2/2019 | Andresen et al. | |
| 10,309,100 | B2 | 6/2019 | Long et al. | |
| 10,329,761 | B2 | 6/2019 | Stahl, Jr. et al. | |
| 10,329,762 | B2 | 6/2019 | Stahl, Jr. et al. | |
| 10,370,846 | B1 | 8/2019 | Neuwirt | |
| 10,538,915 | B1 * | 1/2020 | Zemler | E04B 2/92 |
| 10,731,338 | B1 * | 8/2020 | Zemler | E04B 9/08 |
| 2004/0216416 | A1 | 11/2004 | Hohmann et al. | |
| 2007/0000374 | A1 | 1/2007 | Clark et al. | |
| 2010/0107532 | A1 * | 5/2010 | Shriver | E04B 1/947 52/489.1 |
| 2017/0145685 | A1 * | 5/2017 | Andresen | E04B 2/96 |
| 2018/0010331 | A1 | 1/2018 | Romes | |
| 2018/0142463 | A1 | 5/2018 | Siddhartha et al. | |
| 2018/0142469 | A1 | 5/2018 | Stahl, Jr. et al. | |
| 2018/0163397 | A1 * | 6/2018 | Long | E04B 2/96 |
| 2018/0334799 | A1 * | 11/2018 | Andresen | E04B 1/948 |
| 2019/0078327 | A1 | 3/2019 | Schulz-Hanke et al. | |
| 2019/0153727 | A1 * | 5/2019 | Stahl, Jr. | E04B 2/96 |

OTHER PUBLICATIONS

Extended European Search Report from EP Application No. 21916098.3 dated Nov. 7, 2024.
Office Action from UAE Application No. P6001665/2023 dated Dec. 11, 2024.
International Search Report and Written Opinion from PCT/US21/29531 dated Aug. 3, 2021.
International Search Report and Written Opinion from PCT/US21/29527 dated Aug. 3, 2021.
Office Action from U.S. Appl. No. 17/920,828 dated Apr. 10, 2024.
Office Action from U.S. Appl. No. 17/920,828 dated Aug. 8, 2024.
Office Action from U.S. Appl. No. 17/920,828 dated Oct. 31, 2024.
Office Action from U.S. Appl. No. 17/920,829 dated Jul. 5, 2024.
Notice of Allowance from U.S. Appl. No. 17/920,829 dated Sep. 27, 2024.

* cited by examiner

CURTAIN WALL INSULATION SYSTEM

CROSS-REFERENCE TO RELATED APPLICATIONS

This application is a continuation of U.S. patent application Ser. No. 18/254,742, filed May 26, 2023, which is the U.S. national stage entry of International Application No. PCT/US2021/029530, filed Apr. 28, 2021, which claims priority to and the benefit of U.S. Provisional Patent Application No. 63/132,862, filed Dec. 31, 2020, the entire disclosures of which are incorporated herein by reference.

FIELD

The general inventive concepts relate to insulation systems for preventing a fire from moving between adjacent floors of a building and, more particularly, to a system for insulating a curtain wall structure that includes floor-to-ceiling glass, also referred to as a "zero spandrel" or "short spandrel" curtain wall structure.

BACKGROUND

High rise buildings are typically constructed with concrete floor slabs that "float" within an outer skin or curtain wall structure (i.e., windows and cladding materials interfaced with an aluminum framework). In other words, the curtain wall structure does not carry the load of the floors. The intersection of the curtain wall structure and the floor slabs creates a gap through which a fire on one floor may spread/climb vertically to floors above. Consequently, it is well known to insulate these gaps with fire-resistant materials to retard the spread of a fire from one floor to the next. This insulation takes the form of curtain wall insulation, safing insulation, and the like that fit in and around the framework (e.g., mullions and transoms) of the curtain wall structure. For example, U.S. Pat. No. 7,424,793, the entirety of which is incorporated herein by reference, describes a conventional curtain wall insulation system.

Many high rise building designs include curtain wall structures that feature floor-to-ceiling glass. These curtain wall structures are commonly referred to as zero spandrel or short spandrel curtain wall structures. In zero spandrel or short spandrel curtain wall structures, a bottom surface of a transom is positioned either at the same height as a top surface of the floor slab or a few inches (e.g., 3 inches) above the top surface of the floor slab. Some insulation systems for zero spandrel curtain wall structures utilize T-shaped backer bars and/or L-angles to secure and reinforce the curtain wall insulation. Other insulation systems for zero spandrel curtain wall structures utilize a galvanized steel pan that is attached to the mullions and a transom and is configured to retain the curtain wall insulation.

While conventional insulation systems for zero spandrel curtain wall structures are generally effective, the conventional insulation systems require transport and manual installation of many parts and pieces, which results in a relatively more difficult and lengthy installation. Moreover, conventional insulation systems that require attachment to the vertical mullions can prematurely fail in fire conditions due to the ability of a fire to travel inside the mullion and melt the mullion from the inside out. Furthermore, such conventional insulation systems when used in zero spandrel curtain wall structures are exponentially more likely to fail prematurely due to the smaller size of the vertical mullions used in such structures. Accordingly, there is an unmet need for an improved insulation system that requires transport and manual installation of fewer parts and pieces and that attaches only to a horizontally disposed transom of the curtain wall structure and, thus, can result in an easier installation, a reduced installation time, and a reduced chance of premature failure in fire conditions.

SUMMARY

The general inventive concepts relate to a system for insulating a curtain wall structure, particularly curtain wall structures that include floor-to-ceiling glass, which are commonly referred to as zero spandrel or short spandrel curtain wall structures. The system includes insulation hangers and curtain wall insulation that are configured such that no mechanical attachments to the vertical mullions of the curtain wall structure are made and separate reinforcing components (e.g., T-shaped backer bar) are not required. Accordingly, the system of the present disclosure can be installed easier and more quickly than conventional insulating systems, while also reducing the likelihood of premature failure in fire conditions.

In accordance with the present disclosure, a system for insulating a curtain wall structure connected to a building structure is provided. The curtain wall structure is spaced from a floor slab of the building structure to define a perimeter void. The curtain wall structure includes framing defined by at least first and second vertically disposed and parallel mullions, and a horizontally disposed transom. The system includes a plurality of insulation hangers. Each insulation hanger has a hanger body that includes a vertical leg, a first horizontal leg, a second horizontal leg, and at least one reinforcing member. The vertical leg extends between and connects the first horizontal leg and the second horizontal leg. The first horizontal leg and the second horizontal leg are parallel to one another and extend from the vertical leg in a first direction. The at least one reinforcing member extends from the vertical leg in a second direction. The first direction and the second direction are opposite of one another. The system also includes a curtain wall insulation having opposed outer and inner surfaces and opposed top and bottom surfaces, and a safing insulation having opposed outer and inner surfaces and opposed top and bottom surfaces. Each insulation hanger engages the curtain wall insulation such that the first horizontal leg abuts the top surface of the curtain wall insulation, the vertical leg abuts the outer surface of the curtain wall insulation, and the second horizontal leg passes through the outer surface of the curtain wall insulation and extends into the curtain wall insulation. Each insulation hanger is attached only to the horizontally disposed transom to secure the curtain wall insulation within the framing. The at least one reinforcing member of each insulation hanger engages a bottom surface of the horizontally disposed transom. The safing insulation is disposed within the perimeter void and compression fit between the curtain wall insulation and the floor slab.

In some embodiments of the present disclosure, the system includes a first mullion cover insulation having opposed outer and inner surfaces and opposed top and bottom surfaces. The first mullion cover insulation is attached to the curtain wall insulation such that the outer surface of the first mullion cover insulation abuts the inner surface of the curtain wall insulation, the top surface of the first mullion cover insulation abuts the bottom surface of the safing insulation, and the first mullion cover insulation covers a portion of the first mullion.

In some embodiments of the present disclosure, the system includes a smoke sealant applied to the top surface of the safing insulation.

In some embodiments of the present disclosure, the curtain wall insulation has a height of 6 inches to 9 inches, a depth of 3 inches to 6 inches, and a density of at least 4 $lb/ft^3$.

In some embodiments of the present disclosure, each insulation hanger is configured such that a height of the vertical leg is equal to a depth of the first horizontal leg and a depth of the second horizontal leg.

In some embodiments of the present disclosure, each insulation hanger is configured such that a depth of the vertical leg is equal to a height of the first horizontal leg and a height of the second horizontal leg.

In some embodiments of the present disclosure, each insulation hanger is configured such that the first horizontal leg is perpendicular to the vertical leg. In some embodiments of the present disclosure, each insulation hanger is configured such that the second horizontal leg is perpendicular to the vertical leg. In some embodiments of the present disclosure, each insulation hanger is configured such that both the first horizontal leg and the second horizontal leg are perpendicular to the vertical leg.

In some embodiments of the present disclosure, each insulation hanger is configured such that the at least one reinforcing member is perpendicular to the vertical leg. In some embodiments of the present disclosure, each insulation hanger is configured such that the at least one reinforcing member extends from the vertical leg at an angle in the range of 45° to 90°. In some embodiments of the present disclosure, each insulation hanger is configured such that the hanger body includes two reinforcing members spaced from one another by a distance that is less than or equal to a width of the vertical leg.

In some embodiments of the present disclosure, each insulation hanger is configured such that a height of the at least one reinforcing member is less than a height of the vertical leg. In some embodiments, each insulation hanger is configured such that a height of the at least one reinforcing member is equal to a height of the vertical leg. In some embodiments of the present disclosure, each insulation hanger is configured such that a height of the at least one reinforcing member is less than a height of the vertical leg and is greater than half of the height of the vertical leg.

In some embodiments of the present disclosure, each insulation hanger is configured such that the second horizontal leg includes a leg body having one or more barbs and a tapered end. In some embodiments of the present disclosure, each insulation hanger is configured such that the second horizontal leg is symmetrical about a central axis of the leg body. In some embodiments of the present disclosure, each insulation hanger is configured such that a depth of the second horizontal leg is less than a depth (i.e., thickness) of the curtain wall insulation.

In some embodiments of the present disclosure, each insulation hanger is configured such that the second horizontal leg includes a leg body having a pair of prongs configured to cooperate with a locking washer to retain the curtain wall insulation. In some embodiments of the present disclosure, each insulation hanger is configured such that a depth of the second horizontal leg is greater than a depth (i.e., thickness) of the curtain wall insulation.

In some embodiments of the present disclosure, each insulation hanger is configured such that the first horizontal leg includes a mounting flange that extends from and perpendicular to an end of the first horizontal leg. In some embodiments of the present disclosure, the mounting flange includes an aperture.

In some embodiments of the present disclosure, the hanger body of each insulation hanger is made of galvanized steel.

In embodiments of the present disclosure, the system does not include a reinforcement system at a safing line of the system other than the at least one reinforcing member of each insulation hanger. In embodiments of the present disclosure, the system does not include any mechanical attachments to the mullions.

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which:

FIG. 2A is a perspective view of the insulation hanger. FIG. 2B is a plan view of the insulation hanger. FIG. 2C is a detailed view of a second horizontal leg of the insulation hanger. FIG. 2D is a front elevation view of the insulation hanger. FIG. 2E is a side elevation view of the insulation hanger.

DETAILED DESCRIPTION

Several illustrative embodiments will be described in detail with the understanding that the present disclosure merely exemplifies the general inventive concepts. Embodiments encompassing the general inventive concepts may take various forms and the general inventive concepts are not intended to be limited to the specific embodiments described herein.

The general inventive concepts relate to systems for insulating a curtain wall structure connected to a building structure. The systems include innovative insulation hangers in combination with curtain wall insulation and safing insulation to effectively insulate a curtain wall structure, particularly a zero spandrel or short spandrel curtain wall structure. The insulation hangers and curtain wall insulation are configured such that no mechanical attachments to the vertical mullions of the curtain wall structure are made and separate reinforcing components (e.g., T-shaped backer bar) are not required. Accordingly, the system of the present disclosure can be installed easier and more quickly than conventional curtain wall insulating systems, while also reducing the chances of premature failure in fire conditions.

Figure 1:
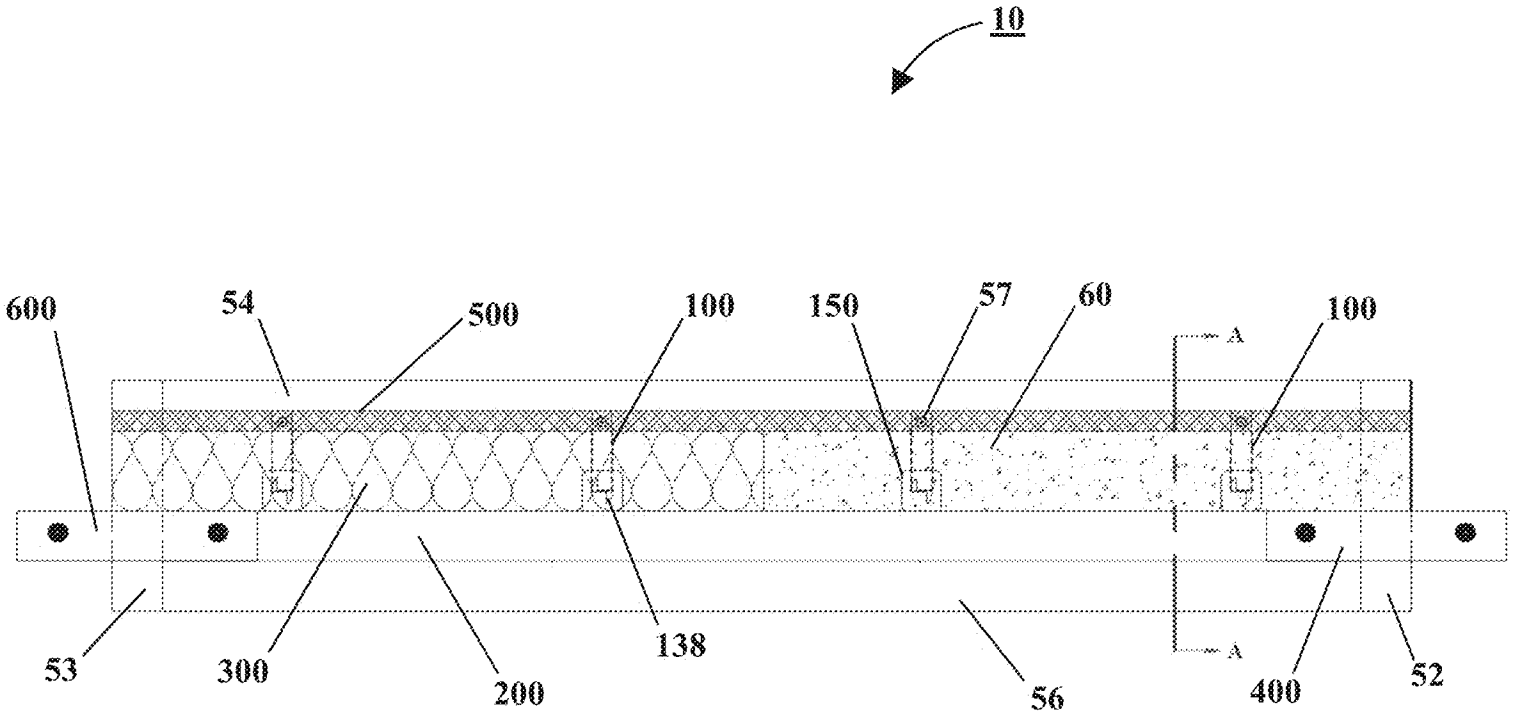
FIG. 1 is a front elevation view of an embodiment of a system for insulating a curtain wall structure of the present disclosure.
Figure 1A:
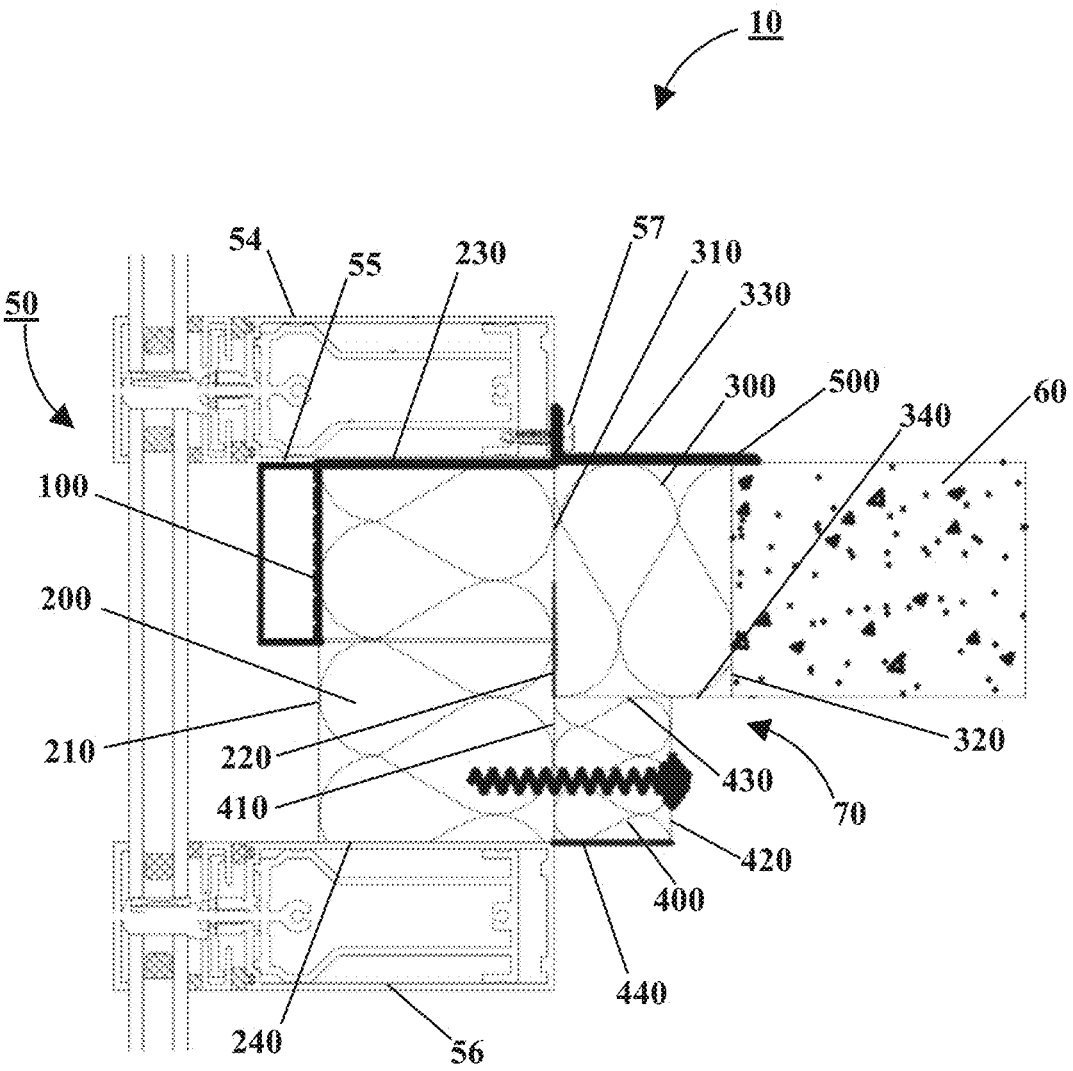
FIG. 1A is a cross sectional view of an embodiment of a system for insulating a curtain wall structure of the present disclosure taken along section line A-A of FIG. 1.

An embodiment of a system 10 for insulating a curtain wall structure 50 in accordance with the present disclosure is shown in FIGS. 1 and 1A. The system 10 is useful for insulating a curtain wall structure 50 connected to a building structure (not shown), particularly zero spandrel or short spandrel curtain wall structures. As one of skill in the art will appreciate, a curtain wall structure 50 is a type of exterior wall system commonly used on buildings, such as high-rise buildings, wherein the curtain wall structure 50 does not bear the load of the building structure. As seen in FIG. 1A, the curtain wall structure 50 is spaced from a floor slab 60 of the building structure to define a perimeter void 70. The curtain wall structure 50 includes framing defined by at least first and second vertically disposed and parallel mullions 52, 53, and a horizontally disposed transom, such as an upper horizontally disposed transom 54 and a lower horizontally disposed transom 56. Although FIGS. 1 and 1A illustrate the framing as having both upper and lower horizontally disposed transom 54, 56, it is contemplated that the framing can omit the lower horizontally disposed transom 56 or include additional horizontally disposed transoms. The system 10 provides thermal insulation and also provides a barrier to inhibit the spread of fire from one floor of a building to an upper adjacent floor through the perimeter void 70. The curtain wall structure 50 illustrated in FIGS. 1 and 1A is exemplary of a zero spandrel curtain wall structure 50 where a bottom surface 55 of a horizontally disposed transom (e.g., upper horizontally disposed transom 54) is positioned at the same height or level as a top surface of the floor slab 60.

As seen in FIGS. 1 and 1A, the system 10 includes a plurality of insulation hangers 100, a curtain wall insulation 200, and a safing insulation 300. The insulation hangers 100 engage the curtain wall insulation 200 and secure the curtain wall insulation 200 within the framing defined by the mullions 52, 53 and transoms 54, 56. The safing insulation 300 is disposed within the perimeter void 70 and compression fit between the curtain wall insulation 200 and the floor slab 60. As shown in FIGS. 1 and 1A, each insulation hanger 100 of the system 10 is attached only to the horizontally disposed transom 54 via a fastener 57 (e.g., a self-drilling, self-tapping screw). In other words, the system 10 does not utilize any mechanical attachments to the mullions to secure the curtain wall insulation 200 within the framing defined by the mullions 52, 53 and transoms 54, 56. As previously mentioned, during a building fire, the fire can travel inside and up the mullions and melt the mullions from the inside out, and thereby melt any mechanical attachments to the mullions. By not utilizing mechanical attachments to the mullions 52, 53, the system 10 of the present disclosure is less likely to prematurely fail as compared to conventional curtain wall insulation systems that utilize mechanical attachments to the mullions.

Referring now to FIGS. 2A-2E, an embodiment of an insulation hanger 100 of the system 10 of the present disclosure is shown. Although specific dimensions may be illustrated in some of the figures, the general inventive concepts are not limited to the disclosed dimensions.

The insulation hanger 100 includes a hanger body 102 that includes a vertical leg 110, a first horizontal leg 120, a second horizontal leg 130, and at least one reinforcing member 140. The hanger 100 can be made of any suitable material. In some embodiments, the hanger 100 is made of a metal including, but not limited to, steel, galvanized steel, brass, and aluminum. Ceramic materials may also be used to form the hanger 100. In certain embodiments, the hanger 100 is formed of galvanized steel, and preferably 20 gauge galvanized steel.

Figure 2A:
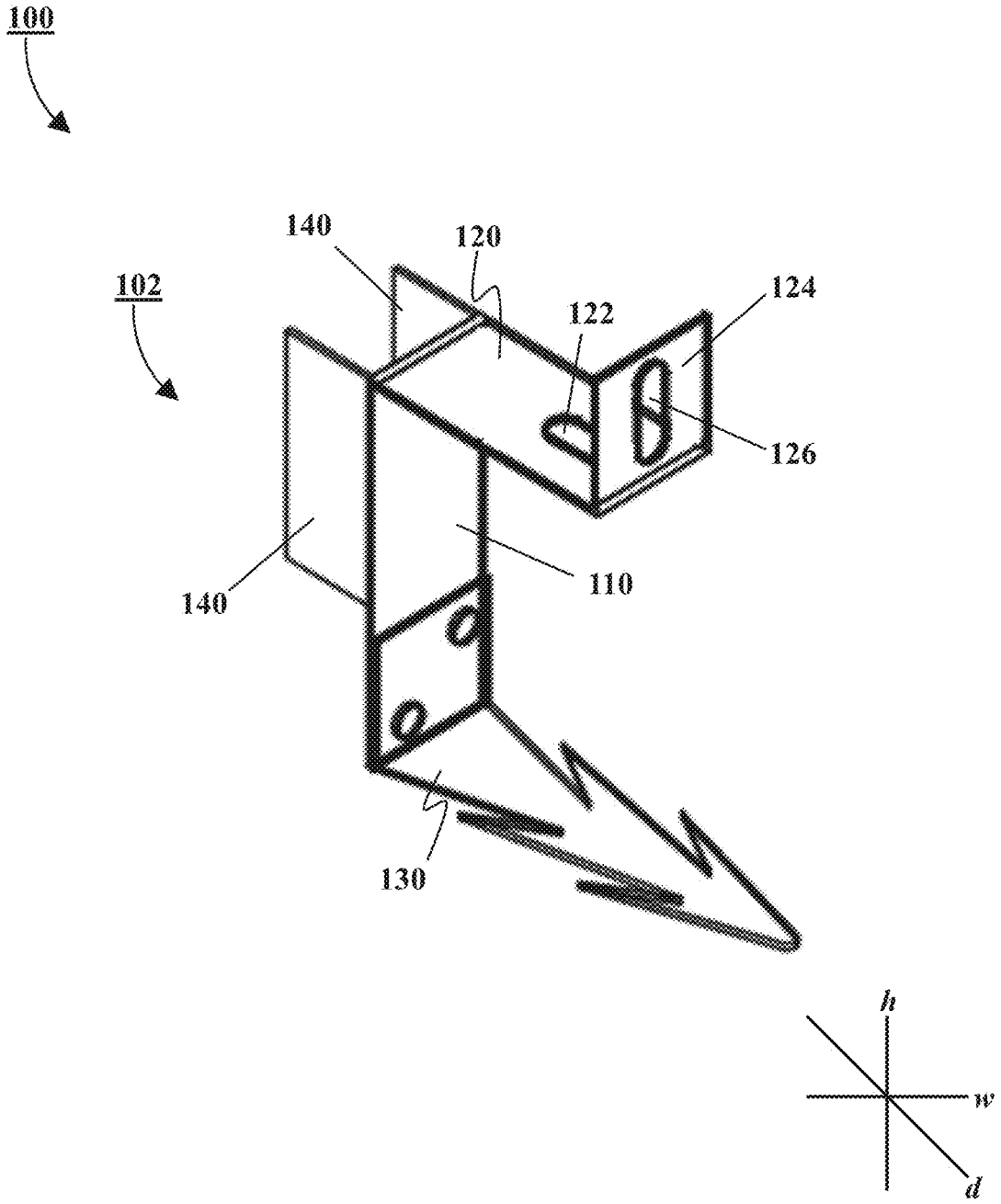
FIGS. 2A-2E illustrate an embodiment of an insulation hanger suitable for use in the system of the present disclosure.

As seen in FIG. 2A, the vertical leg 110 extends between and connects the first horizontal leg 120 and the second horizontal leg 130 to one another. In some embodiments, a height $vl_h$ of the vertical leg 110 is greater than a depth $fl_d$ of the first horizontal leg 120 and a depth $sl_d$ of the second horizontal leg 130. In some embodiments, a height $vl_h$ of the vertical leg 110 is equal to a depth $fl_d$ of the first horizontal leg 120 and a depth $sl_d$ of the second horizontal leg 130. In some embodiments, a depth $vl_d$ of the vertical leg 110 is equal to a height $fl_h$ of the first horizontal leg 120 and a height $sl_h$ of the second horizontal leg 130. In some embodiments, a depth $vl_d$ of the vertical leg 110 is equal to a height $sl_h$ of the second horizontal leg 130 and is less than a height $fl_h$ of the first horizontal leg 120.

Figure 2B:
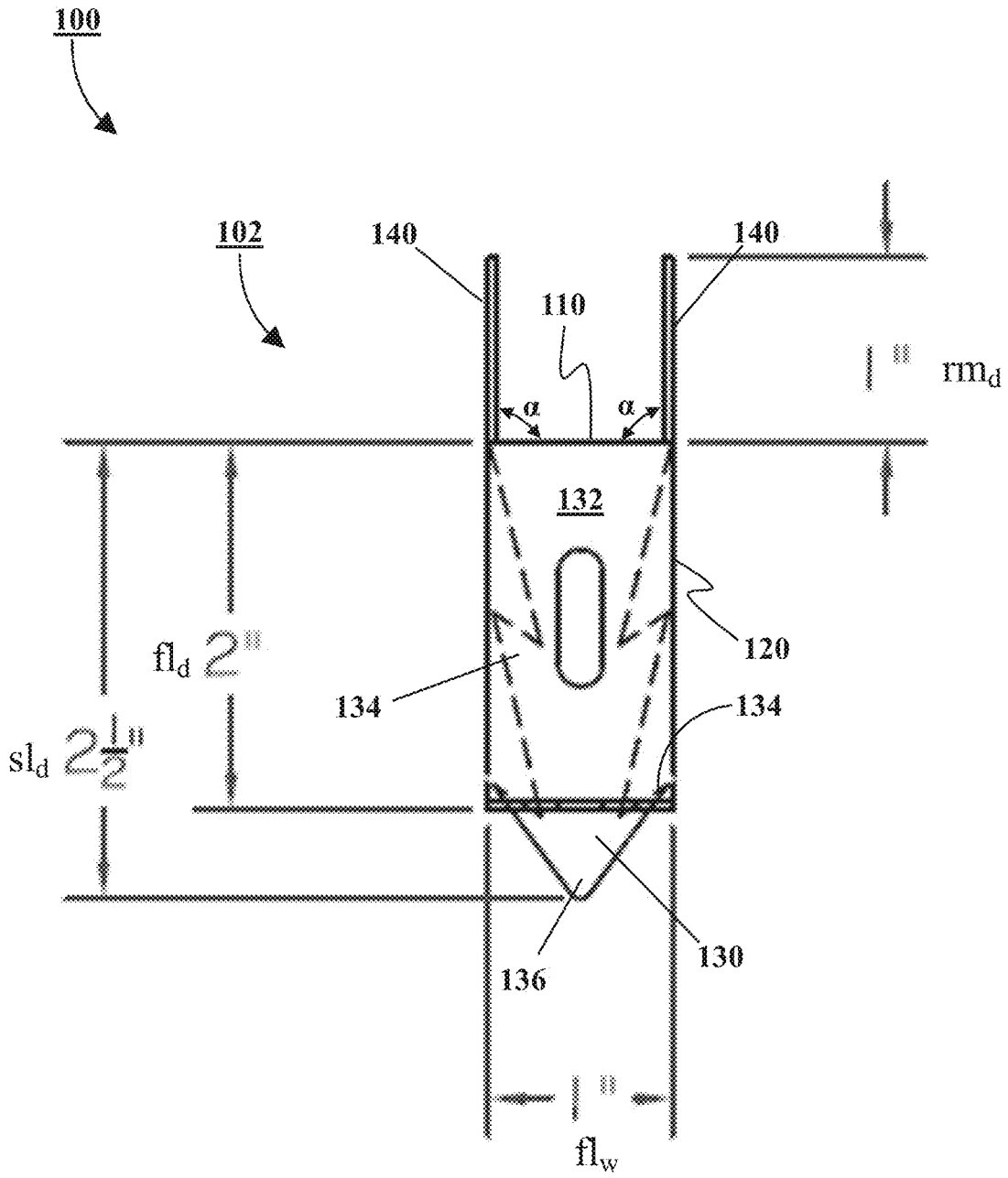
Figure 2C:
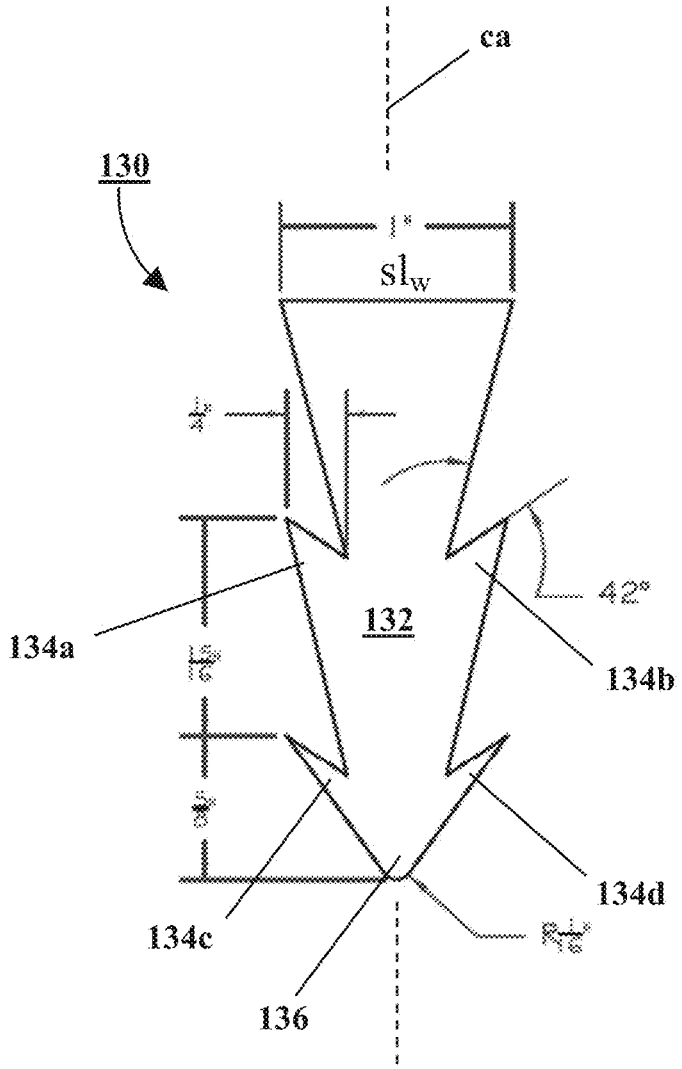
Figure 2D:
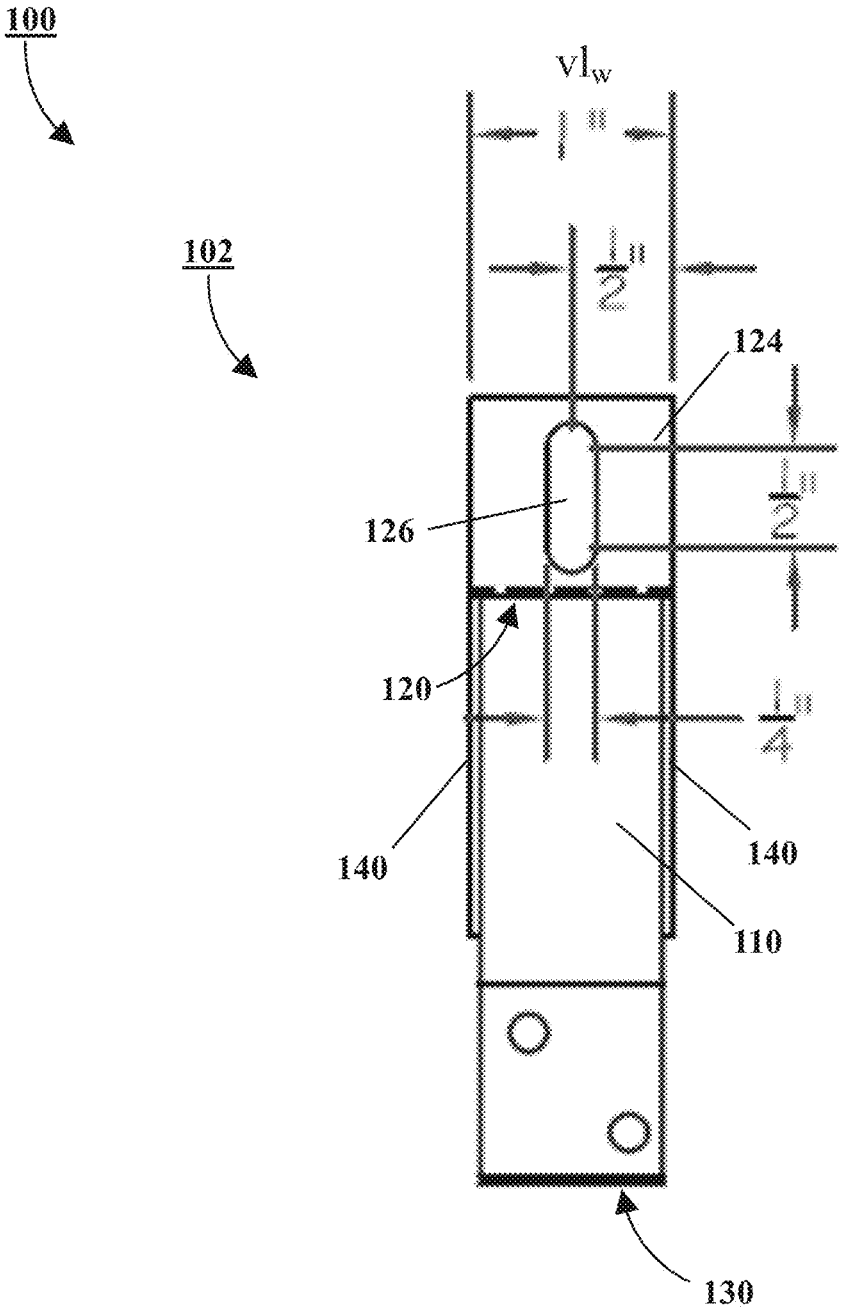
Figure 2E:
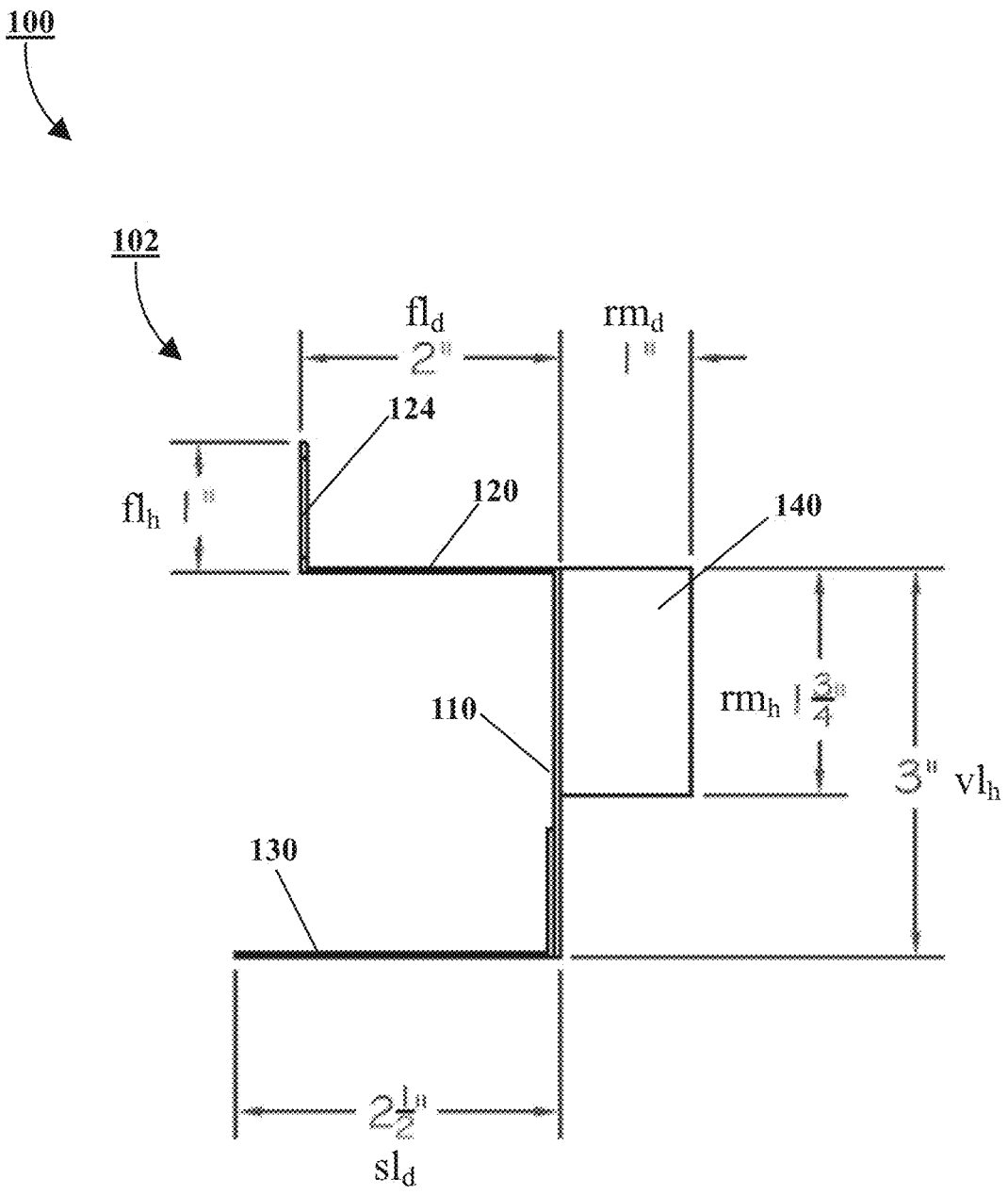

The first horizontal leg 120 extends from the vertical leg 110 in a first direction (e.g., forward of the vertical leg 110), as seen in FIGS. 2A and 2E. In some embodiments, the first horizontal leg 120 is perpendicular to the vertical leg 110. In some embodiments, the first horizontal leg 120 includes at least one aperture 122 therethrough to form a mounting hole. The hanger 100 may be mounted to the horizontally disposed transom 54 by passing a fastener (e.g., screw) through the at least one aperture 122 and into the horizontally disposed transom 54. In some embodiments, the first horizontal leg 120 includes a mounting flange 124 that extends from and perpendicular to an end of the first horizontal leg 120. In some embodiments, the first horizontal leg 120 is perpendicular to the vertical leg 110 and includes a mounting flange 124 that extends from an end of the first horizontal leg 120 and is parallel to the vertical leg 110. In some embodiments, the mounting flange 124 includes an aperture 126 therethrough to form a mounting hole. In some embodiments, the aperture 126 extends through a depth $fl_d$ of the first horizontal leg 120. In some embodiments, the aperture 122 extends through a height $fl_h$ of the first horizontal leg 120. In some embodiments, the first horizontal leg 120 includes an aperture 122 that extends through a height $fl_h$ of the first horizontal leg 120 and a mounting flange 124 having an aperture 126 that extends through a depth $fl_d$ of the first horizontal leg 120. In some embodiments, a depth $fl_d$ of the first horizontal leg 120 is equal to a depth (i.e., thickness) of the curtain wall insulation 200.

As seen in FIGS. 2A and 2E, the second horizontal leg 130 extends from the vertical leg 110 in the first direction (e.g., forward of the vertical leg 110) and is parallel to the first horizontal leg 120. In some embodiments, the second horizontal leg 130 is perpendicular to the vertical leg 110. In some embodiments, a depth $sl_d$ of the second horizontal leg 130 is less than a depth $fl_d$ of the first horizontal leg 120. In some embodiments, a depth $sl_d$ of the second horizontal leg 130 is greater than a depth $fl_d$ of the first horizontal leg 120. In some embodiments, a depth $sl_d$ of the second horizontal leg 130 is equal to a depth $fl_d$ of the first horizontal leg 120. In some embodiments, a height $sl_h$ of the second horizontal leg 130 is equal to a height $fl_h$ of the first horizontal leg 120 before the mounting flange 124. In some embodiments, a height $sl_h$ of the second horizontal leg 130 is less than a height $fl_h$ of the first horizontal leg 120.

As seen in FIGS. 2B and 2C, in some embodiments, the second horizontal leg 130 includes a leg body 132 having one or more barbs 134. The leg body 132 includes a tapered end 136 beyond the barbs 134. The tapered end 136 facilitates passage of the second horizontal leg 130 into a piece of insulation, while the barbs 134 are operable to hold/secure the insulation on the second horizontal leg 130. In some embodiments, the second horizontal leg 130 includes a leg body 132 having a pair of prongs 138 (shown in FIG. 1) that facilitate passage of the second horizontal leg 130 into a piece of insulation. The prongs 138 are configured to cooperate with a locking washer 150 (shown in FIG. 1) (e.g., by passing the prongs through a slot of the locking washer 150 and then bending the prongs 138 in opposite directions) to secure the insulation on the second horizontal leg 130. The leg body 132 of the second horizontal leg 130 may function as a shelf-like ledge operable to support the weight of the insulation.

In some embodiments, a depth $sl_d$ of the second horizontal leg 130 is less than a depth (i.e., thickness) of the curtain wall insulation 200. Accordingly, in some embodiments, the second horizontal leg 130 does not extend completely through the curtain wall insulation 200, which maintains the integrity of a facing of the curtain wall insulation 200, if present. In some embodiments, a depth $sl_d$ of the second horizontal leg 130 is greater than a depth (i.e., thickness) of the curtain wall insulation 200.

While the embodiment of the insulation hanger 100 illustrated in FIGS. 2A-2C shows the same number of barbs 134 on each side of the leg body 132, the general inventive concepts are not so limited. In some embodiments, one or more barbs 134 are only on one side of the leg body 132. In some embodiments, the number of barbs 134 on one side of the leg body 132 differs from the number of barbs 134 on the other side of the leg body 132. While the illustrated embodiment shows the second horizontal leg 130 to be symmetrical about a central axis ca, the general inventive concepts are not so limited. In some embodiments, the size, shape, and/or positions of the barbs 134 differ on opposite sides of the central axis ca of the leg body 132.

As shown in FIG. 2C, in one specific embodiment, the leg body 132 of the second horizontal leg 130 includes four distinct barbs, i.e., a first barb 134*a*, a second barb 134*b*, a third barb 134*c*, and a fourth barb 134*d*. A size, shape, and angle of the first barb 134*a* and the second barb 134*b* are the same. A size, shape, and angle of the third barb 134*c* and the fourth barb 134*d* are the same. In the embodiment illustrated in FIG. 2C, at least one of the size, shape, and angle of the first and second barbs 134*a*, 134*b* is different from that of the third and fourth barbs 134*c*, 134*d*. In the embodiment illustrated in FIG. 2C, the angle of at least the first and second barbs 134*a*, 134*b* is 42°±5°. The general inventive concepts contemplate that the barbs 134 can have any angle suitable to hold the insulation once it is impaled on the second horizontal leg 130.

As mentioned above, the hanger body 102 includes at least one reinforcing member 140. The at least one reinforcing member 140 extends from the vertical leg 110 in a second direction that is opposite of the first direction (e.g., rearward of the vertical leg 110). In some embodiments, the at least one reinforcing member 140 is a flange. In some embodiments, the at least one reinforcing member 140 extends from the vertical leg 110 in a direction (or from a side) different and/or opposite than a direction (or side) that the first horizontal leg 120 and the second horizontal leg 130 extend from the vertical leg 110. As seen in FIG. 2A, each of the reinforcing members 140 extend along a height dimension of the vertical leg 110 and project outward along a depth dimension rearward of the vertical leg 110, whereas the first horizontal leg 120 and the second horizontal leg 130 extend across a width dimension of the vertical leg 110 and project outward along a depth dimension forward of the vertical leg 110. In other words, the at least reinforcing member 140 extends behind the vertical leg 110 and the first horizontal leg 120 and the second horizontal leg 130 extend in front of the vertical leg 110. In some embodiments, the at least one reinforcing member 140 is perpendicular (i.e., angle α is) 90° to the vertical leg 110, as seen in FIG. 2B. In some embodiments, the at least one reinforcing member 140 extends from the vertical leg 110 at an angle α of less than or equal to 90°, such as at an angle α in the range of 45° to 90°. In some embodiments, where there are two reinforcing members 140 extending from the vertical leg 110, each reinforcing member may extend from the vertical leg 110 at an angle α of less than or equal to 90°, such as at an angle α in the range of 45° to 90°.

As shown in FIG. 2B, in one specific embodiment, the hanger body 102 includes two reinforcing members 140 extending from and perpendicular to the vertical leg 110. In this embodiment, the two reinforcing members 140 are spaced from one another by a distance that is less than or equal to a width $vl_w$ of the vertical leg 110. In this embodiment, the reinforcing members 140 have a rectangular shape. The general inventive concepts contemplate that the hanger body 102 can have additional reinforcing members 140 extending from the vertical leg 110 or a single reinforcing member 140 extending from the vertical leg 110, preferably along a central axis of the vertical leg 110. Furthermore, the general inventive concepts contemplate that the reinforcing member 140 can have any suitable shape, such as triangular, that allows the reinforcing member 140 to function as described herein.

In some embodiments, a height $rm_h$ of the reinforcing member 140 is less than a height $vl_h$ of the vertical leg 110. In some embodiments, a height $rm_h$ of the reinforcing member 140 is less than a height $vl_h$ of the vertical leg 110, a depth $fl_d$ of the first horizontal leg 120, and a depth $sl_d$ of the second horizontal leg 130. In some embodiments, a height $rm_h$ of the reinforcing member 140 is equal to a height $vl_h$ of the vertical leg 110. In some embodiments, a height $rm_h$ of the reinforcing member 140 is less than or equal to a height $vl_h$ of the vertical leg 110 but greater than half of the height $vl_h$ of the vertical leg 110 (i.e., $0.5vl_h \leq rm_h \leq vl_h$). In some embodiments, a height $rm_h$ of the reinforcing member 140 is less than a depth $fl_d$ of the first horizontal leg 120 but greater than half of the depth $fl_d$ of the first horizontal leg 120 (i.e., $0.5fl_d < rm_h < fl_d$). In some embodiments, a height $rm_h$ of the reinforcing member 140 is less than a depth $sl_d$ of the second horizontal leg 130 but greater than half of the depth $sl_d$ of the second horizontal leg 130 (i.e., $0.5sl_d < rm_h < sl_d$).

In some exemplary embodiments, a depth $rm_d$ of the reinforcing member 140 is less than a height $vl_h$ of the vertical leg 110, a depth $fl_d$ of the first horizontal leg 120, and a depth $sl_d$ of the second horizontal leg 130. In some exemplary embodiments, a depth $rm_d$ of the reinforcing member 140 is less than a height $rm_h$ of the reinforcing member 140. In some exemplary embodiments, a depth $rm_d$ of the reinforcing member 140 is equal to a height $rm_h$ of the reinforcing member 140. In some exemplary embodiments, a depth $rm_d$ of the reinforcing member 140 is less than or equal to half of a height $vl_h$ of the vertical leg 110 (i.e., $rm_d \leq 0.5vl_h$). In some exemplary embodiments, a depth $rm_d$ of the reinforcing member 140 is less than or equal to three-quarters of a depth $fl_d$ of the first horizontal leg 120 (i.e., $rm_d < 0.75fl_d$). In some exemplary embodiments, a depth $rm_d$ of the reinforcing member 140 is less than or equal to half of a depth $sl_d$ of the second horizontal leg 130 (i.e., $rm_d < 0.5sl_d$).

The at least one reinforcing member 140 provides the hanger body 102 with greater structural integrity to resist deformation when acted on by external forces, particularly during a fire where a lot of turbulence, movement, and gravitational pull exists. In particular, the at least one reinforcing member 140 increases a depth of the insulation hanger 100 and provides at least one additional surface that engages or bears against a bottom surface 55 of the horizontally disposed transom 54, as shown in FIG. 1A, and thereby increases resistance to deformation by external forces exerted on the curtain wall insulation 200 due to the compression fit of the safing insulation 300 or by external forces caused by a fire. Accordingly, the insulation hangers 100 of the system 10 of the present disclosure having at least one reinforcing member 140 can prevent bowing or deformation of the curtain wall insulation 200 due to external forces, such as the compression fit of the safing insulation 300 or forces created during a fire, without the need for a separate reinforcement member (e.g., T-shaped backer bar) at or near a safing line of the system 10.

Referring again to FIGS. 1 and 1A, the system 10 of the present disclosure includes a curtain wall insulation 200. As shown in FIG. 1A, the curtain wall insulation 200 has opposed outer and inner surfaces 210, 220 and opposed top and bottom surfaces 230, 240. The curtain wall insulation 200 may be formed of various materials based on a desired failure temperature of the material such as mineral wool. In certain embodiments, the curtain wall insulation 200 includes a facing (not shown) on an inner surface 220 thereof. The facing may be an aluminum foil or other suitable vapor retarder material. Such curtain wall insulation 200 is commercially available from Thermafiber, Inc. of Wabash, Indiana. The curtain wall insulation 200 used in the system 10 of the present disclosure may have a height of 6 inches to 12 inches (i.e., the distance separating the opposed top and bottom surfaces 230, 240), a depth (or thickness) of 3 inches to 6 inches (i.e., the distance separating the opposed outer and inner surfaces 210, 220), and a density of at least 4 pounds per cubic foot ($lb/ft^3$) (e.g., 4 $lb/ft^3$ to 14 $lb/ft^3$). In some embodiments, the curtain wall insulation 200 has a height of 6 inches to 12 inches, a depth of 3 inches to 6 inches, and a density of at least 6 $lb/ft^3$ (e.g., 6 $lb/ft^3$ to 14 $lb/ft^3$). In some aspects, the curtain wall insulation 200 has a height of 6 inches to 9 inches, a depth of 3 inches to 6 inches, and a density of at least 8 $lb/ft^3$ (e.g., 8 $lb/ft^3$ to 14 $lb/ft^3$). The curtain wall insulation 102 is disposed within the framing defined by the mullions 52, 53 and transoms 54, 56 and is mechanically attached via a plurality of insulation hangers 100 to the horizontally disposed transom 54. Accordingly, the particular size and shape of the curtain wall insulation 200 will typically depend on the particular size and shape of the framing into which the curtain wall insulation 200 is being installed.

Due to its density (e.g., at least 4 $lb/ft^3$, or at least 6 $lb/ft^3$, or at least 8 $lb/ft^3$), the curtain wall insulation 200 is relatively rigid. The combination of the relatively rigid curtain wall insulation 200 with the insulation hangers 100 having at least one reinforcement member 140 and attached only to the horizontally disposed transom 54 provides the system 10 with sufficient reinforcement to resist deformation by external forces without requiring separate reinforcement members (e.g., T-shaped backer bars) or mechanical attachments to the vertical mullions 52, 53. Such design allows the system 10 to be installed easier and more quickly due to the presence of less parts/pieces and points of attachment.

With continued reference to FIGS. 1 and 1A, the system 10 of the present disclosure also includes a safing insulation 300. As seen in FIG. 1A, the safing insulation 300 has opposed outer and inner surfaces 310, 320 and opposed top and bottom surfaces 330, 340. The safing insulation 300 is disposed within the perimeter void 70 and compression fit between the curtain wall insulation 200 and the floor slab 60. The safing insulation 300 inhibits flames and hot gases from moving from a first floor to an adjacent upper floor through the perimeter void 70. As with the curtain wall insulation 200, the safing insulation 300 may be formed of various materials based on a desired failure temperature of the material. In certain embodiments, the safing insulation 300 comprises mineral wool. The safing insulation 300 may have a depth (or thickness) of 1 inch to 8 inches, and a density of 4 $lb/ft^3$ to 8 $lb/ft^3$. Such safing insulation 300 is commercially available from Thermafiber, Inc. of Wabash, Indiana. When installed, the safing insulation 300 is commonly compressed to varying degrees, but normally it is compressed by at least 25% (i.e., compressed thickness of safing insulation is at least 25% less than original, uncompressed thickness). After installation, the safing insulation 300 provides a barrier to fire at the perimeter void 70. Because the safing insulation 300 is compressed when installed, it provides some capability to expand which can seal openings or cracks that might otherwise develop in the perimeter void 70. Slight variations in the size of the perimeter void 70 due to expansion or other environmental changes are accommodated by the safing insulation 300 since it is compressed when placed in the perimeter void 70, and thus can provide an effective seal under various conditions.

In certain embodiments, and as shown in FIGS. 1 and 1A, the system 10 also includes a first mullion cover insulation 400 and a second mullion cover insulation 600 to cover and protect a portion of the first and second mullions 52, 53 from hot flames and gasses during a fire. As seen in FIG. 1A, the first mullion cover insulation 400 has opposed outer and inner surfaces 410, 420 and opposed top and bottom surfaces 430, 440 and is attached to the curtain wall insulation 200 such that the outer surface 410 of the first mullion cover insulation 400 abuts the inner surface 220 of the curtain wall insulation 200 and the top surface 430 of the first mullion cover insulation 400 abuts the bottom surface 340 of the safing insulation 300 and covers a portion of the first mullion 52 (as illustrated in FIG. 1). The mullion cover insulation 400, 600 may be attached to the curtain wall insulation 200 using fasteners (e.g., spiral anchors). Although not specifically illustrated, the second mullion cover insulation 600 is configured and installed in the same manner as the first mullion cover insulation 400 to cover and protect the second mullion 53. The mullion cover insulation 400, 600 may be formed of various materials based on a desired failure temperature of the material. In certain embodiments, the mullion cover insulation 400, 600 comprises mineral wool. In certain embodiments, the mullion cover insulation 400, 600 comprises mineral wool faced on an inner surface with an aluminum foil or other suitable fire resistant vapor retarder material. The mullion cover insulation 400, 600 may have a thickness of 1 inch to 8 inches, and a density of 4 $lb/ft^3$ to 12 $lb/ft^3$. Such mullion cover insulation 400, 600 is commercially available from Thermafiber, Inc. of Wabash, Indiana.

With continued reference to FIGS. 1 and 1A, in certain embodiments, the system 10 includes a smoke sealant 500 applied to a top surface 330 of the safing insulation 300. Any smoke sealant material known in the art may be utilized in the system 10 of the present disclosure. Exemplary smoke sealant materials suitable for use in the system 10 of the present disclosure include, but are not limited to, Fast Tack™ Firestop Spray or Series AS200 Elastomeric Spray smoke sealant, commercially available from Specified Technologies, Inc. (Somerville, New Jersey); Smoke Sealant Compound™ smoke sealant, commercially available from Thermafiber, Inc. (Wabash, Indiana); FireDam™ Spray 200 smoke sealant, commercially available from 3M (St. Paul, Minnesota); and TREMstop Acrylic SP smoke sealant, commercially available from Tremco Incorporated (Ashland, Ohio). The smoke sealant 500 provides a barrier to the passage of smoke and/or hot gasses through the safing insulation 300. Further, in order to retard to the passage of smoke and/or hot gasses through the junctions between the safing insulation 300 and the curtain wall insulation 200, as well as between the safing insulation 300 and the slab 60, the smoke sealant 500 may be applied to extend from ½ inch to 1 inch onto both the curtain wall insulation 200 and the floor slab 60, as shown in FIG. 1A. Typically, the smoke sealant 500 is applied by spraying the smoke sealant material onto the top surface 330 of the safing insulation 300.

The system 10 may be installed by interfacing the plurality of insulation hangers 100 with the horizontally disposed transom 54. More specifically, the plurality of insulation hangers 100 may be secured to the horizontally disposed transom 54 via fasteners 57, such as screws, such that the at least one reinforcing member 140 of each insulation hanger 100 engages or bears against the bottom surface 55 of the horizontally disposed transom 54. After attaching the insulation hangers 100 to the horizontally disposed transom 54, the curtain wall insulation 200 can be pressed onto the second horizontal leg 130 of each insulation hanger 100 such that the first horizontal leg 120 of each hanger 100 abuts the top surface 230 of the curtain wall insulation 200, the vertical leg 110 of each hanger 100 abuts the outer surface 210 of the curtain wall insulation 200, and the second horizontal leg 130 of each insulation hanger 100 passes through the outer surface 210 of the curtain wall insulation 200 and extends into the curtain wall insulation 200. If insulation hangers 100 such as those depicted in FIGS. 2A-2E are used, the installation of the insulation hangers 100 and curtain wall insulation 200 is complete. If insulation hangers 100 such as those depicted in FIGS. 1 and 1A are used, the prongs 138 extend beyond the inner surface 220 of the curtain wall insulation 200 and the locking washer 150 is applied by passing the prongs 130 through a slot of the locking washer 150 and then bending the prongs 138 in opposite directions to retain the curtain wall insulation 200 on the insulation hanger 100. Next, the safing insulation 300 is installed in the perimeter void 70 and compression fit between the inner surface 220 of the curtain wall insulation 200 and the floor slab 60. The mullion cover insulation 400, 600 may then be attached to the curtain wall insulation 200 via fasteners (e.g., spiral screws) such that the top surface of the mullion cover insulation 400, 600 abuts the bottom surface 340 of the safing insulation 300 and covers a portion of the mullions 52, 53. A smoke sealant 500 may then be applied to the top surface 330 of the safing insulation 300.

Alternatively, the system 10 may be installed by interfacing the insulation hangers 100 with the curtain wall insulation 200 prior to interfacing the insulation hangers 100 with the horizontally disposed mullion 54. In particular, a plurality of insulation hangers 100 are interfaced with a portion of curtain wall insulation 200 sized to fit within the framing defined by the mullions 52, 53 and the transoms 54, 56. More specifically, each insulation hanger 100 is pressed into the curtain wall insulation 200 so that the first horizontal leg 120 abuts the top surface 230 of the curtain wall insulation 200, the vertical leg 110 abuts the outer surface 210 of the curtain wall insulation 200, and the second horizontal leg 130 extends into the curtain wall insulation 200. If insulation hangers 100 such as those depicted in FIGS. 2A-2E are used, the barbs 134 on the second horizontal leg 130 effectively secure the curtain wall insulation 200 to the insulation hangers 100. If insulation hangers 100 such as those depicted in FIGS. 1 and 1A are used, the prongs 138 extend beyond the inner surface 220 of the curtain wall insulation 200 and the locking washer 150 is applied by passing the prongs 130 through a slot of the locking washer 150, wherein the prongs 138 are then bent in opposite directions to retain the curtain wall insulation 200 on the insulation hanger 100.

Thereafter, the curtain wall insulation 200 can be positioned and mounted within the framing of the curtain wall structure 50. More specifically, fasteners 57, such as screws, are used to secure the insulation hangers 100 to the horizontally disposed transom 54. In this manner, the curtain wall insulation 200 is mechanically secured within the framing of the curtain wall structure 50. Next, the safing insulation 300 is installed in the perimeter void 70 and compression fit between the inner surface 220 of the curtain wall insulation 200 and the floor slab 60. The mullion cover insulation 400, 600 may then be attached to the curtain wall insulation 200 via fasteners (e.g., spiral screws) such that the top surface of the mullion cover insulation 400, 600 abuts the bottom surface 340 of the safing insulation 300 and covers a portion of the mullions 52, 53. A smoke sealant 500 may then be applied to the top surface 330 of the safing insulation 300.

The terminology as set forth herein is for description of the embodiments only and should not be construed as limiting the disclosure as a whole. All references to singular characteristics or limitations of the present disclosure shall include the corresponding plural characteristic or limitation, and vice versa, unless otherwise specified or clearly implied to the contrary by the context in which the reference is made. Unless otherwise specified, "a," "an," "the," and "at least one" are used interchangeably. Furthermore, as used in the description and the appended claims, the singular forms "a," "an," and "the" are inclusive of their plural forms, unless the context clearly indicates otherwise.

To the extent that the term "includes" or "including" is used in the description or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. Furthermore, when the phrase "one or more of A and B" is employed it is intended to mean "only A, only B, or both A and B." Similarly, when the phrases "at least one of A, B, and C" or "at least one of A, B, C, and combinations thereof" are employed, they are intended to mean "only A, only B, only C, or any combination of A, B, and C" (e.g., A and B; B and C; A and C; A, B, and C).

The system of the present disclosure can comprise, consist of, or consist essentially of the essential elements of the disclosure as described herein, as well as any additional or optional element or feature described herein, or which is otherwise useful in curtain wall insulation applications.

All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, and 10) contained within the range.

Unless otherwise indicated herein, all sub-embodiments and optional embodiments are respective sub-embodiments and optional embodiments to all embodiments described herein. While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details and illustrative examples shown and described. Accordingly, departures may be made from such details without departing from the spirit or scope of applicant's general disclosure herein.

What is claimed is:

1. A system for insulating a curtain wall structure connected to a building structure, the curtain wall structure spaced from a floor slab of the building structure to define a perimeter void and the curtain wall structure having framing defined by at least first and second vertically disposed and parallel mullions, and a horizontally disposed transom, the system comprising:

a plurality of insulation hangers, each of the insulation hangers having a reinforcing member, and each of the insulation hangers being attached to the horizontally disposed transom;

a curtain wall insulation having opposed outer and inner surfaces and opposed top and bottom surfaces; and a safing insulation having opposed outer and inner surfaces and opposed top and bottom surfaces;

wherein each of the insulation hangers engages the curtain wall insulation to hold the curtain wall insulation within the framing;

wherein the reinforcing member of each insulation hanger engages a bottom surface of the horizontally disposed transom;

wherein the safing insulation is disposed within the perimeter void and compression fit between the curtain wall insulation and the floor slab;

wherein the curtain wall insulation is not connected to the first vertically disposed mullion; and wherein the curtain wall insulation is not connected to the second vertically disposed mullion.

2. The system of claim 1, wherein each of the insulation hangers has a hanger body that includes a vertical leg, a first horizontal leg, a second horizontal leg, and the reinforcing member, wherein the vertical leg extends between and connects the first horizontal leg and the second horizontal leg, wherein the first horizontal leg and the second horizontal leg are parallel to one another and extend from the vertical leg in a first direction, and wherein the reinforcing member extends from the vertical leg in a second direction, the first direction and the second direction being opposite of one another.

3. The system of claim 2, wherein a height of the vertical leg is equal to a depth of the first horizontal leg and a depth of the second horizontal leg.

4. The system of claim 2, wherein a depth of the vertical leg is equal to a height of the first horizontal leg and a height of the second horizontal leg.

5. The system of claim 2, wherein the first horizontal leg is perpendicular to the vertical leg.

6. The system of claim 2, wherein the second horizontal leg is perpendicular to the vertical leg.

7. The system of claim 2, wherein the reinforcing member is perpendicular to the vertical leg.

8. The system of claim 2, wherein the reinforcing member extends from the vertical leg at an angle in the range of 45° to 90°.

9. The system of claim 2, wherein a height of the reinforcing member is less than a height of the vertical leg.

10. The system of claim 2, wherein a height of the reinforcing member is equal to a height of the vertical leg.

11. The system of claim 2, wherein a height of the reinforcing member is less than or equal to a height of the vertical leg and is greater than half of the height of the vertical leg.

12. The system of claim 2, wherein the hanger body includes two reinforcing members spaced from one another by a distance that is less than or equal to a width of the vertical leg.

13. The system of claim 2, wherein the second horizontal leg includes a leg body having one or more barbs and a tapered end.

14. The system of claim 13, wherein the leg body includes a plurality of the barbs.

15. The system of claim 14, wherein the leg body includes four of the barbs.

16. The system of claim 14, wherein a number of the barbs on one side of the leg body differs from a number of the barbs on the opposite side of the leg body.

17. The system of claim 13, wherein the second horizontal leg is symmetrical about a central axis of the leg body.

18. The system of claim 2, wherein a depth of the second horizontal leg is less than a thickness of the curtain wall insulation.

19. The system of claim 2, wherein for each insulation hanger engaging the curtain wall insulation to hold the curtain wall insulation within the framing, the first horizontal leg of the insulation hanger abuts the top surface of the curtain wall insulation, the vertical leg of the insulation hanger abuts the outer surface of the curtain wall insulation, and the second horizontal leg of the insulation hanger passes through the outer surface of the curtain wall insulation and extends into the curtain wall insulation.

20. The system of claim 1, further comprising a first mullion cover insulation having opposed outer and inner surfaces and opposed top and bottom surfaces, wherein the first mullion cover insulation is attached to the curtain wall insulation such that the outer surface of the first mullion cover insulation abuts the inner surface of the curtain wall insulation and the top surface of the first mullion cover insulation abuts the bottom surface of the safing insulation and the first mullion cover insulation covers a portion of the first mullion.

21. The system of claim 1, wherein the curtain wall insulation has a height of 6 inches to 12 inches, a depth of 3 inches to 6 inches, and a density of at least 4 $lb/ft^3$.

22. The system of claim 1, wherein the system does not include a reinforcement member at a safing line of the system other than the reinforcing member of each insulation hanger.

23. A system for insulating a curtain wall structure connected to a building structure, the curtain wall structure spaced from a floor slab of the building structure to define a perimeter void and the curtain wall structure having framing defined by at least first and second vertically disposed and parallel mullions, and a horizontally disposed transom, the system comprising:

a plurality of insulation hangers, each of the insulation hangers having a reinforcing member, and each of the insulation hangers being attached to the horizontally disposed transom;

a curtain wall insulation having opposed outer and inner surfaces and opposed top and bottom surfaces; and a safing insulation having opposed outer and inner surfaces and opposed top and bottom surfaces;

wherein each of the insulation hangers engages the curtain wall insulation to hold the curtain wall insulation within the framing;

wherein the reinforcing member of each insulation hanger engages a bottom surface of the horizontally disposed transom;

wherein the safing insulation is disposed within the perimeter void and compression fit between the curtain wall insulation and the floor slab; and wherein the curtain wall insulation is connected to the framing solely by the insulation hangers.

* * * * *